United States Patent [19]

Altfeld et al.

[11] 4,080,152

[45] Mar. 21, 1978

[54] BRACING TUBE FOR PUSHER TYPE OR ROCKER BAR FURNACES

[75] Inventors: Ernst Altfeld, Bochum; Manfred Heerdt, Dortmund-Horde; Heinz Lehmkuhl, Bochum, all of Germany

[73] Assignee: Fried Krupp Huttenwerke AG, Bochum, Germany

[21] Appl. No.: 643,940

[22] Filed: Dec. 23, 1975

[30] Foreign Application Priority Data
Jan. 11, 1975 Germany .....2500954

[51] Int. Cl.[2] ..... F27D 3/02

[52] U.S. Cl. ..... 432/234; 403/379

[58] Field of Search ..... 432/234; 403/379, 378

[56] References Cited

U.S. PATENT DOCUMENTS

| | | | |
|---|---|---|---|
| 1,774,306 | 8/1930 | Werner | 432/234 |
| 2,295,474 | 9/1942 | Horn | 432/234 |
| 3,220,712 | 11/1965 | Lott | 432/234 |
| 3,304,070 | 2/1967 | Jones | 432/234 |
| 3,367,641 | 2/1968 | Molz | 432/234 |
| 3,552,729 | 1/1971 | Hepp et al. | 432/234 |
| 3,588,059 | 6/1971 | Weineck et al. | 432/234 |
| 3,637,198 | 1/1972 | Knaak | 432/234 X |
| 3,801,210 | 4/1974 | Heinold et al. | 403/379 X |

FOREIGN PATENT DOCUMENTS

| | | | |
|---|---|---|---|
| 2,134,622 | 3/1973 | Germany | 432/234 |
| 2,143,214 | 3/1973 | Germany | 432/234 |
| 169,380 | 9/1921 | United Kingdom | 432/234 |

*Primary Examiner*—Irwin C. Cohen
*Attorney, Agent, or Firm*—Haseltine, Lake & Waters

[57] ABSTRACT

A bracing tube construction for pusher type or rocker bar furnaces comprising a bracing tube having a carrier bracket secured thereto. A rider is secured to the carrier bracket and thereby to the tube. The rider has a recess in which the carrier bracket is received and a bore in the rider extends perpendicularly to the tube for receiving a bolt which extends transversely to the tube and is engaged in a groove in the carrier bracket. The carrier bracket has ends engaging corresponding surfaces in the recess in the rider to prevent relative axial movement between the rider and the tube. The bolt and the bore in the carrier bracket are trapezoidal in shape.

13 Claims, 6 Drawing Figures

BRACING TUBE FOR PUSHER TYPE OR ROCKER BAR FURNACES

Figure 1:
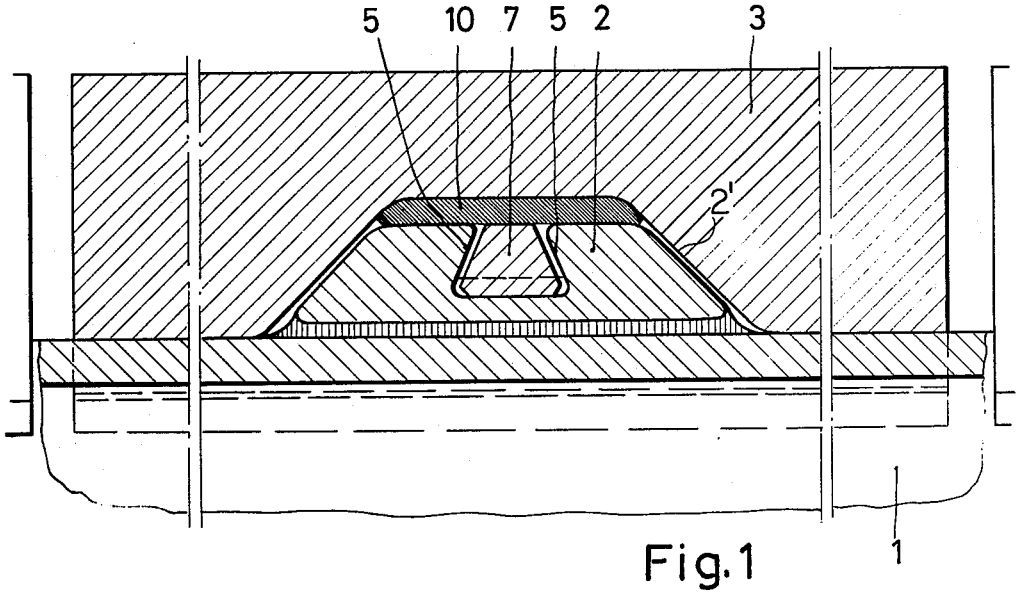

The invention relates to a bracing tube for pusher type or rocker bar type furnaces with riders arranged thereupon which are secured to the tube by bolts, which run transversely to the tube and engage in riders and in carrier brackets secured on the tube, said riders also being secured against axial shifting by form-locking cams, which are secured on the tube between the shanks of the riders and engaged in corresponding recesses in the underside of said riders.

Such a bracing tube, which is determined for pusher type furnaces, is known from the German Offenlegungsschrift 1,583,381. The carrier brackets are in the form of flaps and are arranged on both sides of the riders. These flaps and the riders are pierced by the bolt and in this way secured against removal. The securing against axial shifting is achieved by an additional means, that is by the form-locking cams which mesh in the under side of the riders and are secured on the tube. The riders are laterally supported by further special elements, i.e. by supports which are arranged on both sides of the riders and are welded onto the tube. Subsequently, three different elements are needed in this known bracing tube for protection against removal and axial shifting and for laterally supporting the riders. Furthermore, it is necessary to protect the lateral supports as well as the cooled tube against direct heat absorption by means of a heat-insulating material, as only the riders are made of heat-proof material. If no heat protection is provided, the cooled tube would produce black stripes on the bars to be heated.

An object of the invention consists in providing a simpler structure for securing the riders on a bracing tube of a pusher type or rocker bar furnace which protects both against removal and against axial shifting and also, if necessary, gives lateral support.

This object is solved according to the invention in that the carrier brackets are formed from the cams.

The invention is based on the knowledge that the riders can be secured against removal as well as against axial shifting with one and the same element, that is the welded cam, when the bolt is allowed to engage in the carrier bracket for the riders. The lateral supporting can be achieved by spreading the shanks of the riders, which protect the tube against direct heat absorption like a heat screen.

The carrier brackets are preferably roof-shaped in axial cross-section. The recess for the bolt can be thereby formed in each carrier bracket as a groove which is open at the top and which becomes wider at the bottom, whereby the bolt is fixed in the cross-section of this groove.

The possibility exists in such a formation of bolt and groove that the bolt is positioned loose so that additional forces cannot arise, for example, from heat stress. Despite this however, a safe mounting support of the rider is guaranteed.

As an advantage, the carrier brackets are secured on a bar, which extends along the complete length of the tube and is connected with the tube over its complete length, for example, by welding. The carrier brackets can thereby be welded directly onto the tube.

It has proved especially expedient to burn out the carrier bracket consisting of, for example, a plate 50 mm thick together with the bar by means of an acetylene cutting machine and to weld the bar over the complete length of the tube without reworking directly onto the bracing tube.

The groove and bolt should preferably be trapezoid-shaped in cross-section so that, on the one hand, the bolt can be lightly fitted and there remains sufficient clearance for possible heat expansion, and on the other hand a large abutment is achieved between the bolt and the groove on removal.

The ends of the bolt may be positioned within the riders and may be screened from outside by a stamping mass which is placed in the holes for protection against the effect of heat.

Figure 1A:
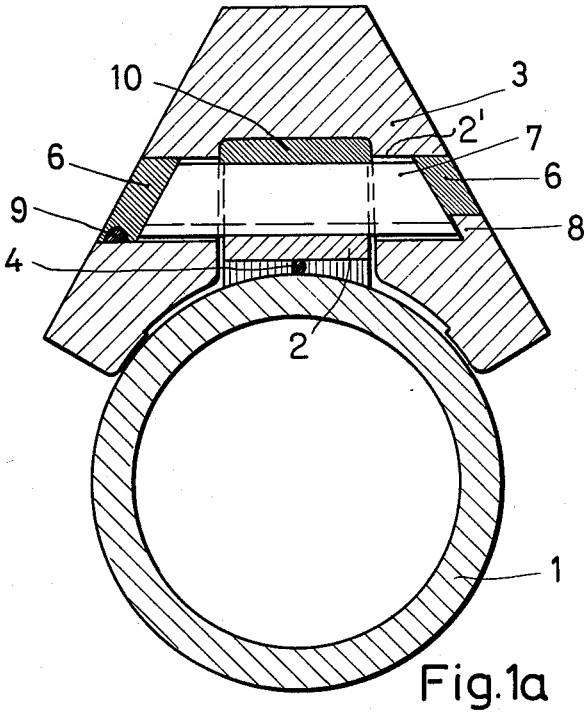
Figure 2:
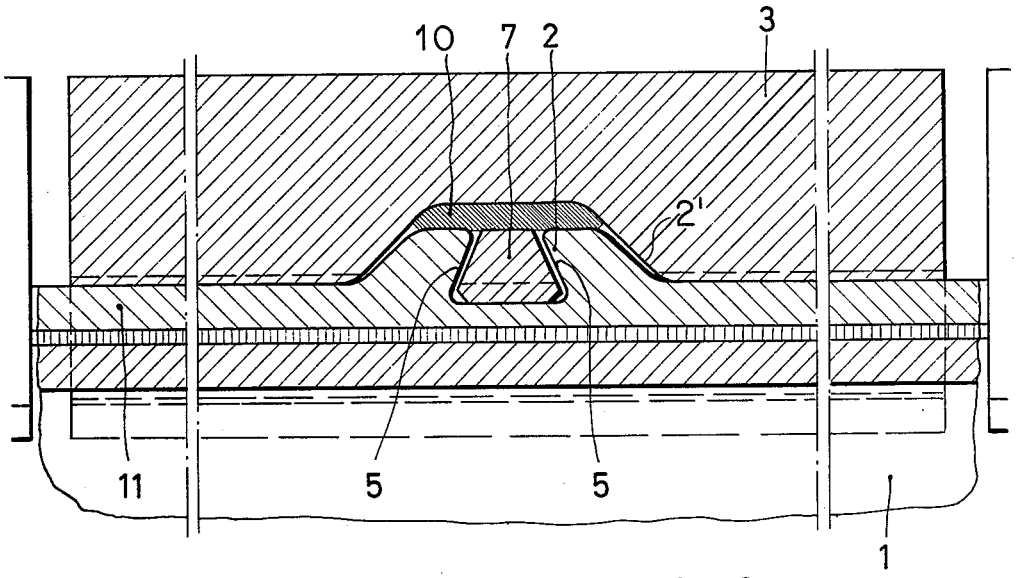

The invention is represented by means of several embodiments in the drawings and is described in more detail as follows:

FIG. 1 shows a bracing tube with a rider in axial cross-section;

FIG. 1*a* shows the bracing tube according to FIG. 1*a* in cross-section;

FIG. 2 shows a second bracing tube with a rider in axial cross-section

Figure 2A:
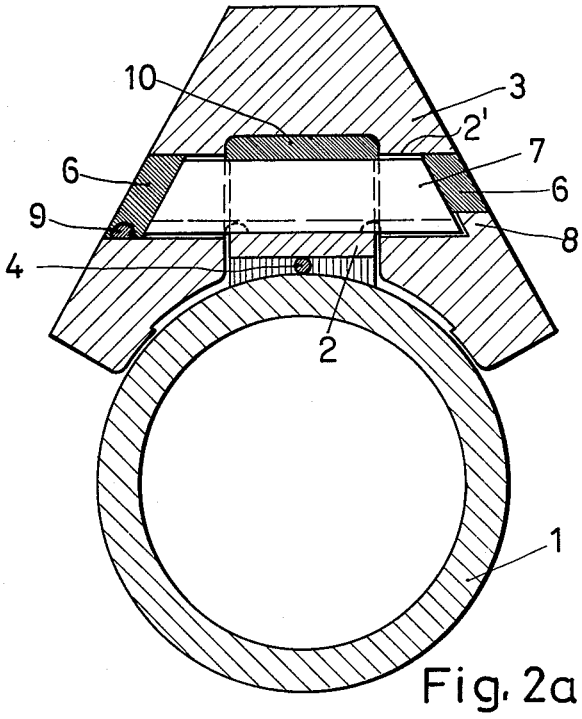
Figure 3:
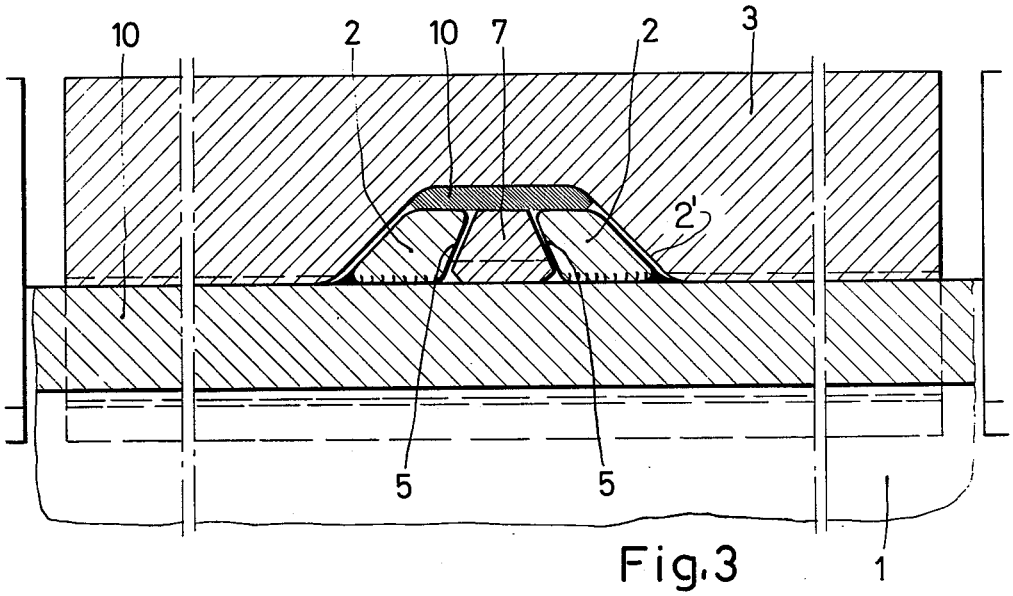

FIG. 2*a* shows the bracing tube according to FIG. 2*a* in cross-section;

FIG. 3 shows a third bracing tube with a rider in axial cross-section; and

Figure 3A:
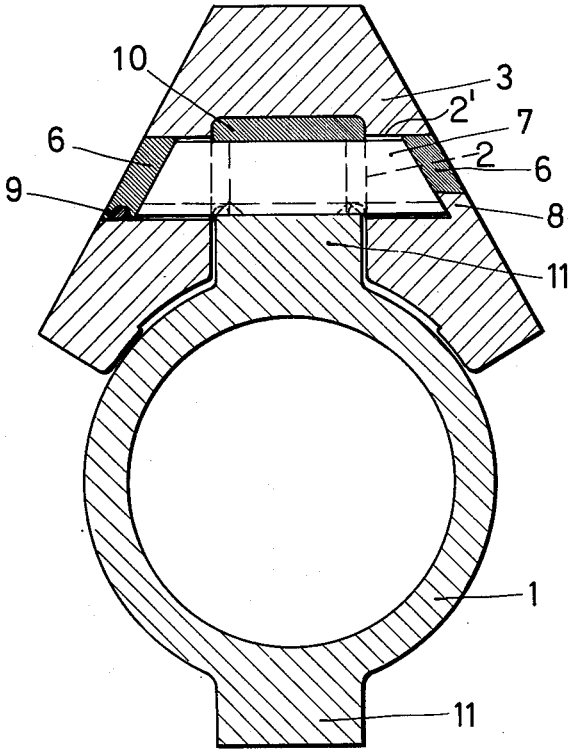

FIG. 3*a* shows the bracing tube according to FIG. 3*a* in cross-section.

A carrier bracket 2, which is rectangular in cross-section and roof-shaped in side view, is directly welded to a bracing tube 1 as shown in FIGS. 1 and 1*a*. A continuous wire 4 is placed between the bracing tube and the carrier bracket 2 to enable the gap between these two parts to be welded. The wire 4 fixes the height of the carrier bracket 2 exactly in relation to the bracing tube 1 and guarantees that the structure is well welded through. A rider 3 with a recess for the roof-shaped carrier bracket 2 is supported on the tube 1 by its shanks and has a bone 2' which extends perpendicular to the tube's axis and at one end the rider is provided with a lip or catch 8. A trapezium-shaped groove 5 in the carrier bracket 2 is oriented relative to the bore 2' in such a way that their openings align with one another after the rider 3 has been put on. To secure the rider 3 on the bracing tube 1, a bolt 7 corresponding to the trapezoidal-shaped groove 5 is pushed towards the catch 8 into the rider 3. The bore 2' is provided with a weld bead 9 at the outer end of the bolt 7 opposite to the catch 8 in order to maintain said bolt 7 in its position. Said weld bead 9 is, on the one hand, large enough to prevent the bolt 7 from dropping out, and on the other hand, is provided in such a way and its size is such that it can be easily removed again on disassembling the rider 3. A heat-insulating layer 10, which is unaffected by changes in temperature, lies in the area between the carrier bracket 2 with the bolt 7 and the recess 2' in the rider 3, in order to protect the carrier bracket 2 with the bolt 7 against excessive effect of heat to the outside thereof. Both ends of the bolt 7 are screened by a suited stamping mass 6 which closes the openings of the bore.

With the construction as given above, the riders are adapted for supporting advancing workpieces thereon in pusher type or rocker bar furnaces.

A further embodiment of the invention is shown in FIGS. 2 and 2*a*. This differs from the previous illustration in that the carrier bracket is not welded singly onto the bracing tube 1 but forms a part of a bar 11 which is directly welded onto the bracing tube 1 and extends along the complete length of the tube. The bracing tube 1, which is under high stress is strengthened by this continuous bar 11. A homogeneous construction is achieved by the bar 11 with the carrier brackets 2 being formed in one piece, as well as by the bar 11 being welded over the complete length of the tube 1. This construction does not provide any points of attack for cracks, thus guaranteeing long operational use.

In the embodiment shown in FIGS. 3 and the bar 11 is joined to the bracing tube 1. The carrier bracket 2 comprises two parts which are welded to the bar 11 and are formed in such a way that dovetailed groove 5 is produced between them.

We claim:

1. A bracing tube construction for pusher type or rocker bar type furnaces, comprising a bracing tube, a carrier bracket, means securing said carrier bracket to said tube, a rider, means securing said rider to said carrier bracket and thereby to said tube, said rider having a recess in which said carrier bracket is received and a bore extending perpendicularly to said tube at opposite ends of said recess, said means securing the rider to said carrier bracket comprising a bolt extending transversely to said tube and disposed in a groove provided in said carrier bracket, said bolt having ends extending beyond said carrier bracket into said bores, said carrier bracket having ends engaging corresponding surfaces in said recess in said rider thereby to prevent relative axial movement between said rider and said tube, said groove in the carrier bracket being tapered and widening towards the bottom, said bolt having a shape corresponding to said groove and being fitted in said groove.

2. A construction as claimed in claim 1, wherein said carrier bracket has inclined ends tapering upwardly in axial cross-section.

3. A construction as claimed in claim 1, comprising a bar extending along the complete length of the tube and connected to said tube over its complete length, and means securing said carrier bracket to said bar.

4. A construction as claimed in claim 3, wherein said carrier bracket and said bar are integrally formed as one piece.

5. A construction as claimed in claim 1, wherein said carrier bracket is directly welded to the tube.

6. A construction as claimed in claim 1, wherein said groove and said bolt are trapezoidal-shaped in cross-section.

7. A construction as claimed in claim 1, comprising means in said bore for covering the ends of said bolt.

8. A construction as claimed in claim 7, wherein said means in said bore comprises a screening shield constituted by a mass positioned in said bore.

9. A construction as claimed in claim 1, comprising a catch in said rider engaging one end of the bolt to prevent removal thereof in one axial direction.

10. A construction as claimed in claim 7, comprising a weld bead in said rider for maintaining the other end of the bolt to prevent removal thereof in one axial direction.

11. A construction as claimed in claim 1, comprising a layer of a heat-insulating heat resistant material positioned between the top of the carrier bracket and said rider.

12. A construction as claimed in claim 1, wherein said ends of the carrier bracket are inclined with respect to the axis of said tube and said surfaces in said recess in said rider which they engage are correspondingly inclined.

13. A construction as claimed in claim 1 wherein said groove in the carrier bracket is open at the top.

* * * * *